United States Patent [19]

Stotler

[11] 3,962,070

[45] June 8, 1976

[54] H-COAL PROCESS: SLURRY OIL RECYCLE SYSTEM

[75] Inventor: Harold H. Stotler, Westfield, N.J.

[73] Assignee: Hydrocarbon Research, Inc., Morristown, N.J.

[22] Filed: Jan. 14, 1974

[21] Appl. No.: 433,198

Related U.S. Application Data

[63] Continuation of Ser. No. 214,958, Jan. 3, 1972, abandoned.

[52] U.S. Cl. ..... 208/10

[51] Int. Cl.[2] ..... C10G 1/08

[58] Field of Search ..... 208/10

[56] References Cited

UNITED STATES PATENTS

| | | | |
|---|---|---|---|
| 1,934,023 | 11/1933 | Wright | 208/10 |
| 3,540,995 | 11/1970 | Wolk et al. | 208/10 |
| 3,565,751 | 2/1971 | Hoekstra | 208/10 |
| 3,617,474 | 11/1971 | Stotler et al. | 208/10 |

*Primary Examiner*—Delbert E. Gantz
*Assistant Examiner*—James W. Hellwege

[57] ABSTRACT

In the hydrogenation of particulate coal in an ebullated bed reactor to produce hydrocarbon products, the improvement which comprises removing the coarser unreacted particulate from the recycled residiuum stream from the reactor by a liquid cyclone separation, recycling the overhead stream from said cyclone separation to the reaction zone, removing finer particulate solids from an additional liquid residiuum stream and also providing a net filtrate stream which is distilled to produce hydrocarbon vapor and liquid streams and combining said liquid stream with liquid resulting from condensation and fractionation of overhead vapor from the reactor to produce a synthetic crude oil.

2 Claims, 2 Drawing Figures

H-COAL PROCESS: SLURRY OIL RECYCLE SYSTEM

This is a continuation of application Ser. No. 214,958, filed Jan. 3, 1972, now abandoned.

BACKGROUND OF THE INVENTION

The ebullated bed process for hydrogenation of coal is described in Johanson, U.S. Pat. No. Re. 25,770, and in Keith et al., U.S. Pat. No. 3,519,555. An extension of the teachings is disclosed in Wolk et al., U.S. Pat. No. 3,540,995. This process converts coal to hydrocarbon gases, distillate and residuum oils by direct contact with hydrogen in an ebullated catalyst bed reactor. The present invention is directed to improvements in the process to minimize the production of residuum and maximize the production of valuable oil distillates. It has been found that the yield of distillates can be increased materially by increasing the residuum composition in the reactor liquid. This can be accomplished by recycling a residuum stream back to the reactor. However, the stream leaving the ebullated bed reactor which contains residuum also contains the unconverted coal and ash product. Therefore, at least a portion of this stream must be reduced in solids concentration before it can be recycled back to the reactor to prevent the solids concentration in the reactor liquid from increasing to an inoperable composition. But it has also been found that there is a limit to the separability of the uncoverted coal and ash contained in the residuum stream to be recycled with the use of only liquid cyclones.

SUMMARY OF THE INVENTION

The present invention is directed to an improved method for controlling the solids level in the recycle residuum stream by a combination of liquid cyclones and precoat filters which results in a more effective and economic method for increasing distillate yield.

In accordance with this invention, it has been determined that a significant proportion of the unconverted coal and ash produced from coal in the hydrogenation operation is of a particle size which is too fine to be separable from the residuum stream by a liquid cyclone. This places a limitation on the quantity of residuum stream which can be recycled to the reactor even after separation by a liquid cyclone to prevent an inoperable high concentration of these fine solids in the reactor liquid. Therefore, to increase this quantity of recycle residuum stream it is necessary to pass at least a portion of the recycle residuum stream through a more positive liquid-solid separator such as a precoat rotary filter.

This and other advantages will become apparent upon consideration of the following description of the drawings and preferred embodiments.

DESCRIPTION OF THE PREFERRED EMBODIMENT

Figure 1:
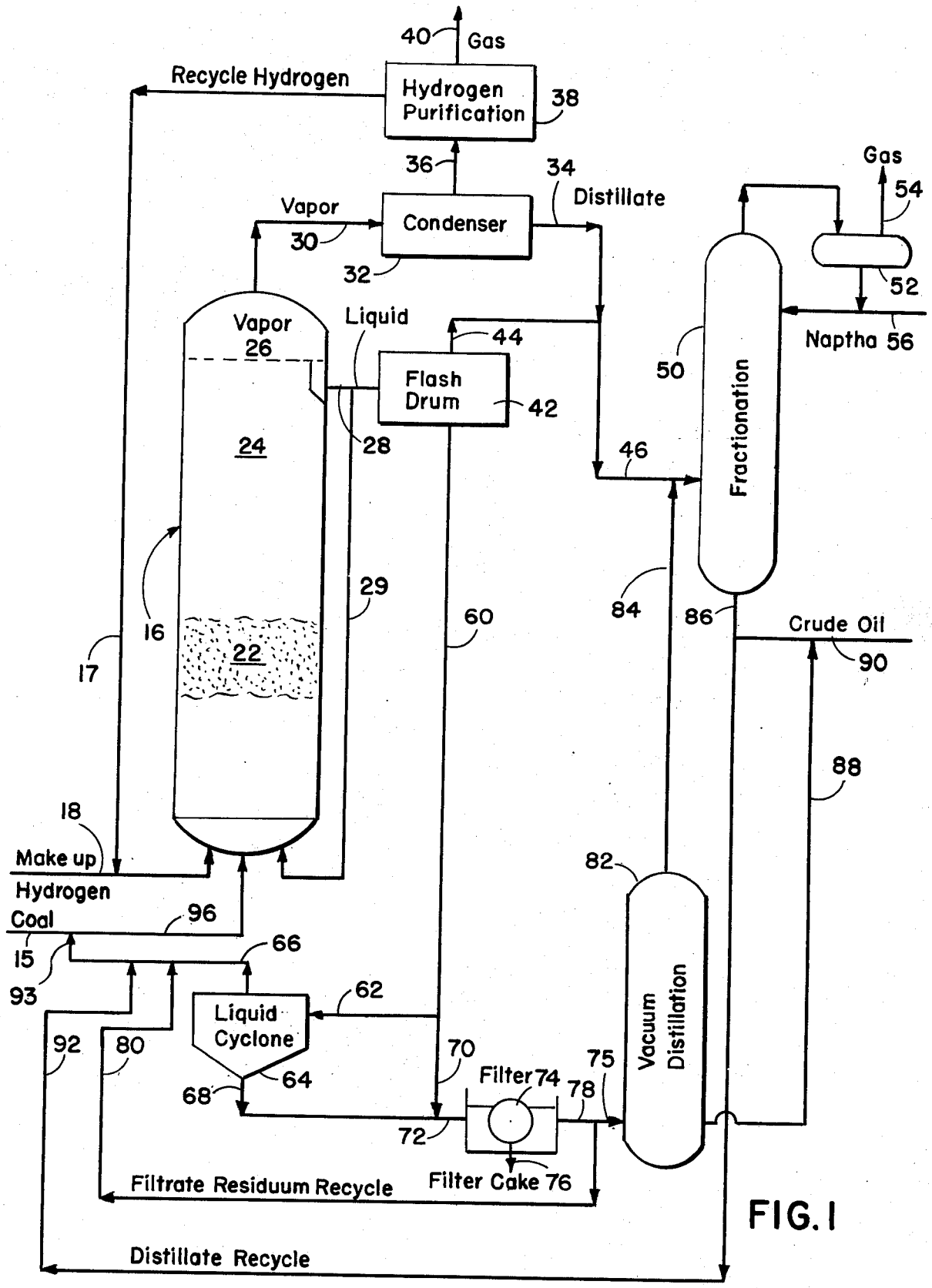
FIG. 1 is a schematic flow diagram of the ebullated bed coal hydrogenation process wherein the recycle residuum stream is decreased in solids content by the combinations of liquid cyclones and filtration according to the present invention.

In a commercial process as shown in FIG. 1, the coal at 15 is slurried with a recycle oil, hereinafter defined, to provide an oil-coal slurry of from 1 to 1 to as high as 5 to 1 ratio on a weight basis. This oil-coal slurry in line 96 is then fed to an upflow type reactor 16 of the type described in Johanson U.S. Pat. No. Re. 25,770. Recycle hydrogen in stream 17 combines with make-up hydrogen in stream 18 and passes to the bottom of reactor 16 where it flows upwardly through the reactor.

The reactor 16 has three zones, an ebullated catalyst zone 22, a catalyst disengaging liquid zone 24 and a reactor vapor zone 26. The coal entering the bottom of the reactor is hydrogenated to form gas and liquid products in the reaction zone which is operated in the temperature range of 750° to 900°F and at hydrogen partial pressures of 1000 to 4000 psig. The unconverted coal and ash, being smaller in particle size and lighter in density than the catalyst, passes up through the ebullated zone 22 into the catalyst disengaging liquid zone 24 and is withdrawn from the reactor with the reactor liquid effluent stream 28.

A part of the reactor liquid effluent stream 28 may be recycled through line 29 to the bottom of reactor 16 where it also flows upwardly through the reactor with the joint streams 15, 18 and 93 flowing at a rate to maintain the catalyst in the bed, in an ebullated state. As described in U.S. Pat. No. Re. 25,770, this stream 29 may be carried by internal or external piping.

Suitable catalyst for coal hydrogenation has heretofore been described in U.S. Pat. No. 3,519,555. It is preferably in the form of beads, pellets, lumps, chips or like particles at least 1/32 inch in one dimension and more frequently in the range of 1/16 to one-fourth inch or between about 3 and 14 mesh (Tyler) screen. Such a catalyst is from the class of cobalt, molybdenum, nickel, iron, tin and the like deposited on a base of the class of alumina, magnesia, silica and the like.

The reactor effluent vapor at 26 is withdrawn in stream 30, cooled in condenser 32 and the condensed distillates are removed in stream 34. Hydrogen leaving in stream 36 is enriched by conventional means in hydrogen purification unit 38 and the light hydrocarbon gases are removed in stream 40. Enriched hydrogen may be recycled back to reactor 16 by stream 17.

The net effluent reactor liquid containing unconverted coal and ash leaving reactor 16 in stream 28 is partially cooled and flashed to a relatively low pressure in flash drum 42. Vapors from flashdrum 42 in stream 44 join condensed distillates in stream 34 and pass in stream 46 to fractionator 50 where naphtha and crude oil are separated. An overhead separator 52 separates gas as 54 from liquid, part of which is used as reflux and part of which is withdrawn as naphtha product at 56.

The flashed reactor liquid leaving flash drum 42 as stream 60 contains residuum and unreacted coal and ash. A portion of stream 60 passes by stream 62 to liquid cyclone 64. Since it has been found that a significant percentage of the uncoverted coal and ash produced from the feed coal are of a particle size too small to be separated in a liquid cyclone there is not adequate separation of these fine solid particles from the liquid. The purpose of cyclone 64 is to decrease the concentration of the coarser particles in the cyclone overhead stream 66 which is part of the residuum recycled back to the reactor as coal slurrying oil 93.

Stream 68, the underflow from cyclone 64, which is now concentrated in coarse solids, joins stream 70 which bypasses cyclone 64 to form stream 72 which passes to a precoat rotary drum filter 74. In some cases, there may be no flow in stream 70 and all of stream 60 including the coarse solids and the fine solids produced from the coal then passes through cyclone 64. The filter cake leaves filter 74 by stream 76 and a portion of the filtrate in line 78 splits into stream 80 which provides additional residuum recycle to reactor 16. The net filtrate liquid in line 75 passes to vacuum distillation at 82. Vapor from this distillation in stream 84 joins stream 46 and is fed to fractionator 50. Bottoms from fractionator 50 in line 86 is joined by distillation bottoms stream 88 to provide a synthetic crude oil product in stream 90. Some of this type material as distillate recycle may also be used as slurry oil in line 92. The oil stream 93 used to slurry the feed coal thus consists of the cycloned residuum reycle stream 66, the filtrate recycle residuum stream 80 and distillate recycle stream 92.

The critical particle size of the unconverted coal and ash appears to be in the 10 to 15 micron range. That is, particles larger than this can be separated in a liquid cyclone and only a minor separation of smaller particles can be made. Experimental results have shown that as much as 40 weight percent of the unconverted coal and ash can be of this fine particle size which are not separable in a liquid cyclone.

Figure 2:
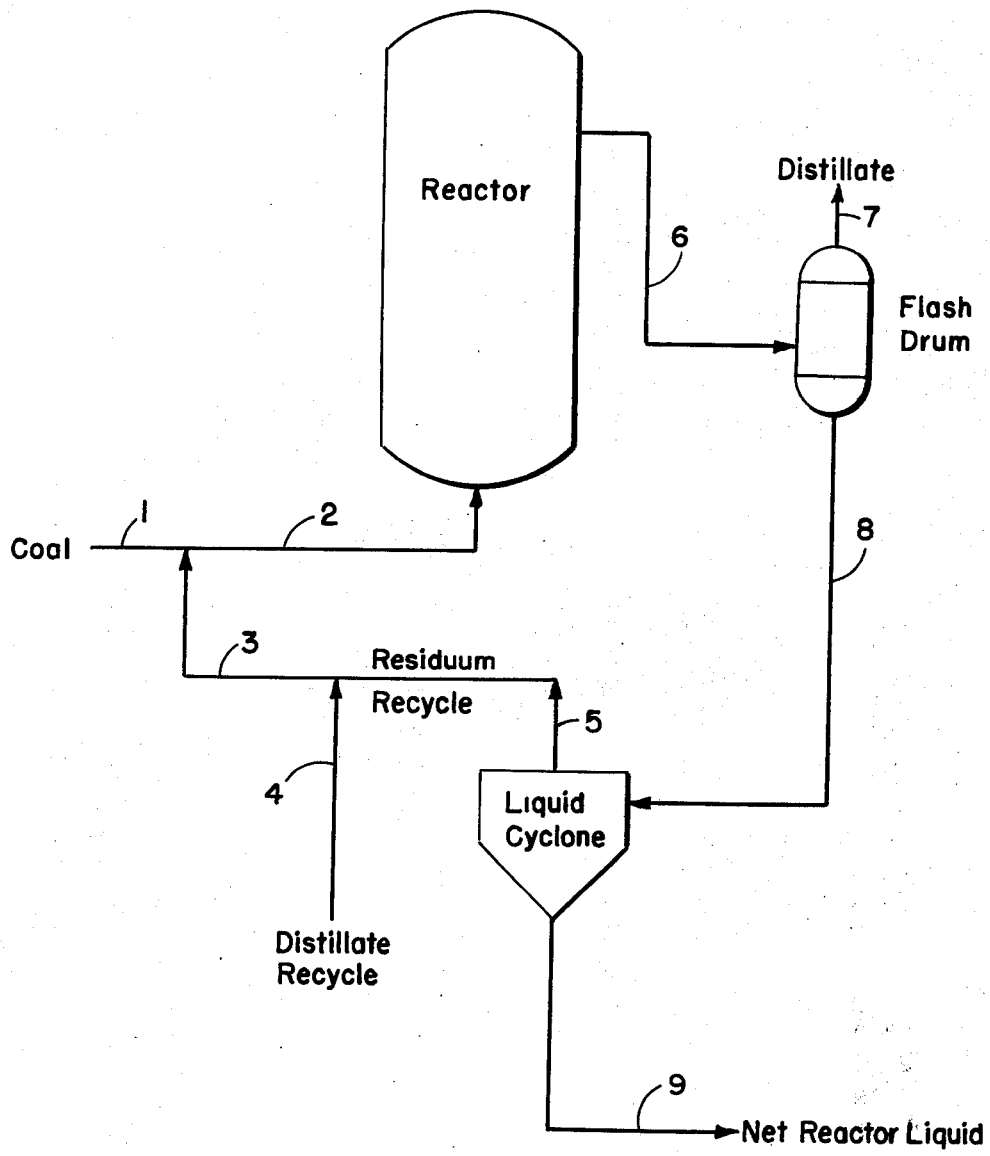
(Prior Art) FIG. 2
FIG. 2 schematically shows the process streams according to the prior art to illustrate the advantages of the combined cyclone-filtration operation over only a liquid cyclone operation.

FIG. 2, when compared with FIG. 1, demonstrates the difference between operating an H-Coal plant with only the use of cyclones for removing solids in a recycle residuum stream as suggested by the Wolk et al. U.S. Pat. No. 3,540,995, and the present invention in which a combined cyclone and filter operation is used.

In FIG. 2, the coal in stream 1 is slurried with oil in stream 3 and fed to the reactor. The reactor effluent liquid leaving in stream 6 is flashed in the flash drum at a relatively low pressure and vapor distillates are removed in stream 7. Flashed reactor liquid leaving in stream 8 enters the liquid cyclone. The overhead from the liquid cyclone which has been reduced in solids concentration leaves as stream 5. This stream is combined with distillate recycle stream 4 to provide the slurry oil as stream 3. The cyclone underflow 9 is net reactor liquid which is sent to fractionation to recover bottoms net product and recycle distillate. In this operation, the yield of residuum (stream 8) was 23.9 lbs/100 lb/coal when operating at a reactor liquid solids free concentration of 41.7 weight percent. As a result, 38 pounds of recycle residuum/100 lb. feed coal were required to maintain the residuum concentration of 41.7 weight percent. It will be noted in the following table that the liquid cyclone decreased the coarse solids concentration from 6.7 in stream 8 to 2.7 percent in the recycle residuum stream 5 but that there was substantially no separation of fine solids from the liquid. The solids concentration in the reactor liquid was 14.7 weight percent which is within the tolerance of operability.

The data from FIG. 2 is:

| Stream; 1000 lb/hr | 1 | 2 | 3 | 4 | 5 |
|---|---|---|---|---|---|
| Fresh Coal | 2120 | 2120 | — | — | — |
| Unconverted Coal & Oil | | | | | |
| Fine | — | 191 | 191 | — | 191 |
| Coarse | — | 55 | 55 | —11 | 55 |
| Distillate | — | 1537 | 1537 | 553 | 984 |

-continued

| Stream; 1000 lb/hr | 1 | 2 | 3 | 4 | 5 |
|---|---|---|---|---|---|
| Residuum | — | 808 | 808 | —11 | 808 |
| Total | — | 4711 | 2591 | 553 | 2038 |
| % Fine solids | — | — | — | — | 9.4 |
| % Coarse solids | — | — | — | — | 2.7 |
| Stream; 1000 lb/hr | | 6 | 7 | 8 | 9 |
| Fresh Coal | | — | — | — | — |
| Unconverted Coal & Oil | | | | | |
| Fine | | 311 | — | 311 | 120 |
| Coarse | | 234 | — | 234 | 179 |
| Distillate | | 1848 | 247 | 1601 | 617 |
| Residuum | | 1315 | — | 1315 | 507 |
| Total | | 3708 | 247 | 3461 | 1423 |
| % Fine solids | | 18.4 | — | 9.0 | 8.4 |
| % Coarse solids | | 6.3 | — | 6.7 | 12.6 |

FIG. 1 represents the flows when the reactor is operated with a liquid composition of 39.6 wt. percent residuum (solid-free) and the yield of residuum is 10.8 lbs/100 lb. coal. Here the coal in stream 15 is slurried with oil in stream 93 to provide the slurry in stream 96 which is fed to the reactor. The reactor liquid effluent leaving in stream 28 is flashed to a low pressure in the flash drum 42 and distillate vapors are removed in stream 44. The liquid leaving in stream 60 is sent to a liquid cyclone 64. Overflow in line 66 from the cyclone 64 in which the coarse solids concentration has been reduced to 3.1 wt. percent, provides part of the recycle residuum. The underflow in line 68 from the liquid cyclone passes in stream 72 to the precoat rotary filter 74. Filtrate removed in stream 78 splits into stream 80, which provides additional residuum recycle, and stream 75 which is the net reactor liquid.

Data from FIG. 1 is as follows:

| Stream; 1000 lb/hr | 15 | 93 | 92 | 80 | 66 |
|---|---|---|---|---|---|
| Fresh Coal | 2100 | — | — | — | — |
| Unconverted Coal & Oil | | | | | |
| Fine | — | 184 | — | — | 184 |
| Coarse | — | 56 | — | — | 56 |
| Distillate | — | 1455 | 245 | 314 | 896 |
| Residuum | — | 884 | — | 230 | 654 |
| Total | — | 2579 | 245 | 544 | 1790 |
| % Fine solids | — | 7.1 | — | — | 10.3 |
| % Coarse solids | — | 2.2 | — | — | 3.1 |
| Stream; 1000 lb/hr | 96 | 28 | 44 | 60 | 68 |
| Fresh Coal | 2100 | — | — | — | — |
| Unconverted Coal & Oil | | | | | |
| Fine | 184 | 313 | — | 313 | 129 |
| Coarse | 56 | 248 | — | 248 | 192 |
| Distillate | 1456 | 1700 | 178 | 1522 | 626 |
| Residuum | 883 | 1110 | — | 1110 | 456 |
| Total | 4679 | 3371 | 178 | 3193 | 1403 |
| % Fine solids | — | 9.3 | — | 9.8 | 9.2 |
| % Coarse solids | — | 7.4 | — | 7.8 | 13.7 |
| Stream: 1000 lb/hr | 76 | 78 | 75 | | |
| Fresh Coal | — | — | — | | |
| Unconverted Coal & Oil | | | | | |
| Fine | 129 | — | — | | |
| Coarse | 192 | — | — | | |
| Distillate | — | 626 | 312 | | |
| Residuum | — | 456 | 226 | | |
| Total | 321 | 1082 | 538 | | |
| % Fine solids | — | — | — | | |
| % Coarse solids | — | — | — | | |

With the lower yield of residuum in accordance with this invention it was necessary to recycle 42 lbs. residuum/ 100 lbs. coal to operate at a reactor liquid residuum concentration of 39.6 wt. percent. By recycling only 31 lbs. of residuum/100 lbs. coal as cyclone overflow line 66 and 11 lbs. of residuum/100 lbs. coal in line 80 as solids free filtrate the solids concentration in the reactor liquid is kept at 16.7 wt. percent which is operable.

Since a liquid hydroclone does not separate out the fine solids in the reactor effluent liquid, the underflow from the cyclone must contain sufficient quantity of liquid to purge the fine solids produced from the coal when the feed stream to the cyclone is low enough in solids concentration to provide an operable concentration of solids in the reactor liquid. In FIG. 1 with only 10.8 percent residuum yield, this could only be accomplished by using 51 lbs. of liquid/100 lbs. coal cyclone underflow. Since the liquid concentration of residuum is 42 percent in this stream it was necessary to purge 21.7 lb. of residuum per 100 lb. coal as cyclone underflow to purge out the fine solids. Since the yield of residuum was 10.8 lb/100 lb. coal it was necessary to recycle 10.9 lb. residuum/100 lb. coal to maintain the high residuum concentration in the reactor liquid.

TABLE I

| Product yields in lbs. per 100 lbs. dry coal | Prior Art (FIG.2) | This Invention (FIG.1) |
|---|---|---|
| Distillate | 45.5 | 54.2 |
| Residuum | 23.9 | 10.8 |
| Unconverted Coal & Ash | 14.1 | 16.4 |
| Wt. % Residuum in Reactor Liquid, solids-free | 41.7 | 39.6 |

While I have shown and described a preferred form of embodiment of my invention, I am aware that modifications may be made thereto within the scope and spirit of the description herein and of the claims appended hereinafter.

I claim:

1. In a process for the hydrogenation of coal wherein particulate coal is admixed with a liquid hydrocarbon to form a coal-oil slurry which is passed with hydrogen through a reaction zone under hydrogenation temperature and pressure conditions and the coal is hydrogenated to produce hydrocarbon products including a liquid residuum having unconverted processed solids contained therein and wherein the reactor liquid residuum concentration is maximized to reduce the yield of liquid residuum by recycling to the reaction zone a portion of said liquid residuum in the coal-oil slurry, and wherein the solids concentration in the reactor liquid is maintained below 20 weight percent, the improvement which comprises:

1. removing the coarser particulate solids from at least part of the recycled residuum stream by liquid cyclone separation;
2. recycling the overhead stream from said liquid cyclone separation step to the reaction zone;
3. removing by filtering finer particulate solids from an additional liquid residuum stream recycled to the reaction zone and also providing a net filtrate liquid stream;
4. subjecting the net filtrate liquid to a distillation step to produce hydrocarbon vapor and liquid streams; and
5. combining the liquid from said distillation with a liquid resulting from condensation and fractionation of the overhead vapor from the reaction zone to produce a synthetic crude oil.

2. A process as claimed in claim 1 wherein the portion of solids removed by liquid cyclone has a particle size greater than about 15 microns and wherein the portion of solids removed by filtering has a particle size less than about 15 microns and the filtration is accomplished by a rotary filter.

* * * * *